US005738318A

United States Patent [19]

Thole et al.

[11] Patent Number: 5,738,318

[45] Date of Patent: Apr. 14, 1998

[54] CHAIR WITH VERTICALLY SHIFTABLE HEIGHT ADJUSTMENT

[75] Inventors: Douglas M. Thole, Grandville; Larry A. Wilkerson, Comstock Park, both of Mich.

[73] Assignee: Haworth, Inc., Holland, Mich.

[21] Appl. No.: 660,459

[22] Filed: Jun. 7, 1996

[51] Int. Cl.[6] ..... F16M 11/26

[52] U.S. Cl. ..... 248/188.5; 248/161; 248/631

[58] Field of Search ..... 248/188.5, 188.8, 248/188.1, 404, 161, 631; 297/344.18, 344.19; 267/64.12, 64.26

[56] References Cited

U.S. PATENT DOCUMENTS

| | | | |
|---|---|---|---|
| 519,884 | 5/1894 | Browne . | |
| 668,321 | 2/1901 | Sonnex . | |
| 725,033 | 4/1903 | Brigham . | |
| 762,086 | 6/1904 | Ritter . | |
| 1,111,586 | 9/1914 | Hurlbert . | |
| 1,233,859 | 7/1917 | Fertig et al. . | |
| 1,373,079 | 3/1921 | King . | |
| 1,694,243 | 12/1928 | Wilford . | |
| 1,959,682 | 5/1934 | May . | |
| 2,216,348 | 10/1940 | Hunsicker . | |
| 2,352,678 | 7/1944 | Angell . | |
| 2,691,503 | 10/1954 | Bigelow . | |
| 2,893,470 | 7/1959 | Peller . | |
| 3,999,733 | 12/1976 | Harder, Jr. et al. . | |
| 4,183,689 | 1/1980 | Wirges et al. | 248/404 X |
| 4,793,197 | 12/1988 | Petrovsky . | |
| 4,979,718 | 12/1990 | Bauer et al. | 297/344.19 X |
| 5,078,351 | 1/1992 | Gualtieri | 248/404 X |
| 5,234,187 | 8/1993 | Teppo et al. | 248/161 |
| 5,497,966 | 3/1996 | Furhrmann | 248/188.5 X |

*Primary Examiner*—Ramon O. Ramirez

*Attorney, Agent, or Firm*—Flynn, Thiel, Boutell & Tanis, P.C.

[57] ABSTRACT

A chair having a base adapted for support on a floor, a seat-back arrangement for accommodating an occupant, and an upright telescopic height adjustable pedestal assembly connected vertically between the base and the seat-back arrangement for supporting the latter and permitting the height thereof to be vertically adjusted. The height adjustable pedestal assembly include a first height adjusting mechanism having a predetermined vertical stroke defined between upper and lower stroke limiting positions for permitting the height of the seat-back arrangement to be adjusted to any position along said stroke; and a second height adjusting mechanism defining at least upper and lower vertically-spaced range positions for permitting the vertical length of the pedestal assembly to be respectively increased and decreased, whereby the seat-back arrangement can be subjected to the predetermined vertical stroke of the first height adjustment mechanism when in either of the upper and lower range positions. The first and second height adjusting mechanisms are connected vertically in series, and each is independently operable.

22 Claims, 8 Drawing Sheets

CHAIR WITH VERTICALLY SHIFTABLE HEIGHT ADJUSTMENT

FIELD OF THE INVENTION

This invention relates to a height adjusting mechanism for a chair, such as an office chair, and more particularly to an improved height adjusting mechanism which permits the height adjusting stroke to be vertically shifted from a low range to a high range so as to effectively increase the overall height adjusting range of the chair.

BACKGROUND OF THE INVENTION

Chairs used in offices and other commercial environments typically employ a central pedestal having a height adjusting mechanism associated therewith, such often being a mechanical device, but recently more typically being a pneumatic spring or cylinder device. Such conventional height adjusting devices provide a limited height adjusting capability, which capability with most gas springs provides a maximum height adjustment of five inches or less, with the lower and upper positions typically being respectively about 16 and 20½ inches above the floor, as established by industry standards. However, due to the wide range of physical characteristics possessed by occupants of such chairs, and specifically the desire to be able to adjust a chair to readily and interchangeably accommodate both short and tall occupants, and due also to modern technological work needs of the chair occupant, there is an increased demand for chairs which have the capability of providing a greater height adjustment range. That is, there is a need to expand both the upper and lower limits of the typical height adjustment range.

One attempt to provide an increased stroke is illustrated by U.S. Pat. No. 5,234,187. The height adjusting mechanism of this latter patent includes upper, intermediate and lower support tubes which are slidably telescopically related and interconnected by a drive mechanism so that, during extension, the upper and intermediate tubes simultaneously extend with respect to one another and also simultaneously extend relative to the lower tube. While such mechanism does provide an increased stroke, nevertheless such mechanism is considered to be overly complex and expensive, and subject to potentially increased maintenance.

Further, it is believed that the need for increased stroke will not occur in many use situations, particularly those where a chair is used primarily by a single occupant. Rather, the need for increased stroke is believed more often desirable for use on a chair which is subject to periodic changes in occupants, such as a chair which is first used by a tall occupant who is desirous of having the chair at a relatively high level or height, and is then used by a short occupant who is desirous of having the chair at a low level or height. Such use thus does not require a long or increased stroke for any particular occupant. Rather, a conventional stroke for each occupant is acceptable, but it is desirable to have different elevations or basic heights from which the conventional height-adjusting stroke is defined.

In recognition of the above, the present invention relates to an improved height adjusting assembly for a chair, which assembly employs a generally conventional first height adjusting mechanism having a generally conventional stroke. The height adjusting assembly includes a second height adjusting mechanism which operates independently of the first mechanism and permits the stroke of the first mechanism to be vertically shifted to provide upper and lower stages or elevations from which the first height adjusting mechanism is activated. This enables the overall assembly when in the lower stage to have a conventional stroke generated upwardly from a bottom height limit that is lower than is normally provided, and when the second mechanism is shifted into a second or upper stage, then this causes the stroke defined by the first mechanism to again be of same magnitude but generated upwardly from a new higher bottom limit. This enables the height adjusting assembly of the chair, and specifically the second height adjusting mechanism, to be manually adjusted between upper and lower positions or stages to thus shift the height adjusting stroke either upwardly or downwardly depending upon the selection by the occupant.

In the improved height adjusting assembly of this invention, as aforesaid, the first and second mechanism are connected generally in aligned and coaxial series relationship within the upright pedestal of the chair so that the first height adjusting mechanism, which preferably constitutes a conventional pneumatic spring, provides the usual or conventional vertical stroke. The second mechanism is manually activated, such as by a rotatable knob or lever, to rotate a control sleeve associated with the pedestal. This control sleeve enables an upper part of the height adjusting assembly to be moved axially along the sleeve between upper and lower support positions which respectively define first and second base elevations or stages, with the first height adjusting mechanism then having its usual stroke and being effective for raising the chair upwardly away from the selected first or second base elevational positions.

Other objects and purposes of the invention will be apparent to persons familiar with structures of this general type upon reading the following specification and inspecting the accompanying drawings.

Figure 1:
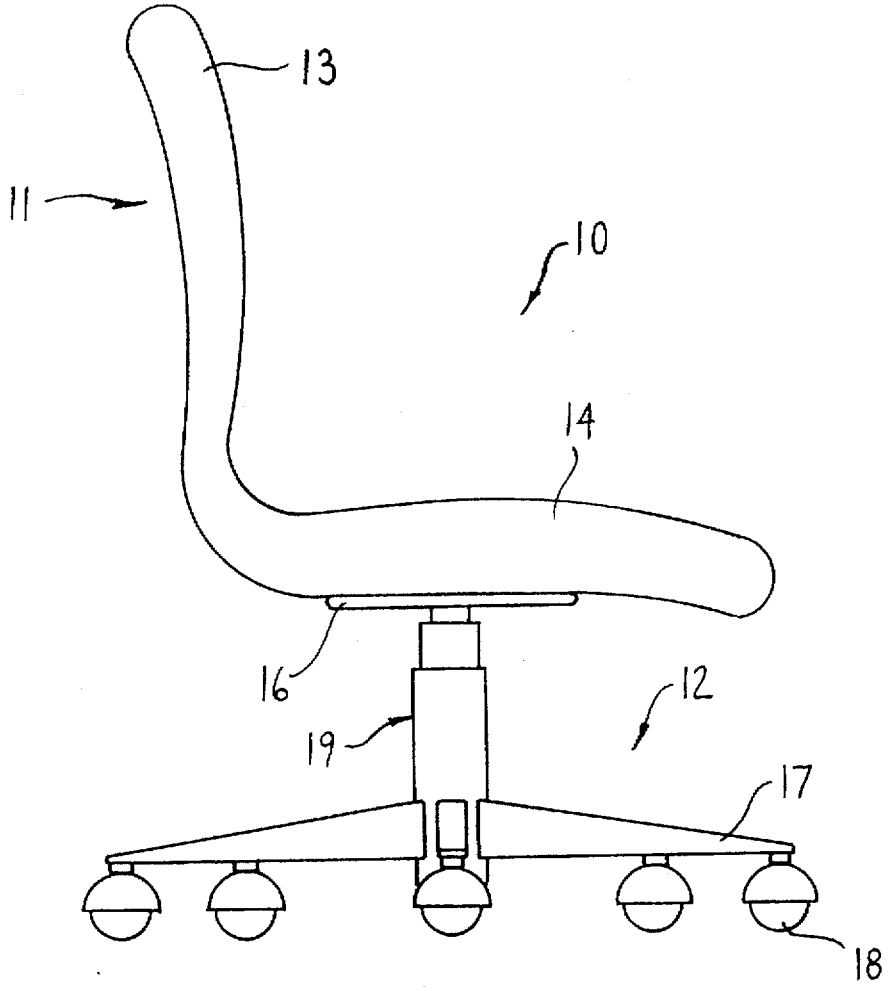
FIG. 1 is a diagrammatic elevational view of a chair.
Figure 2:
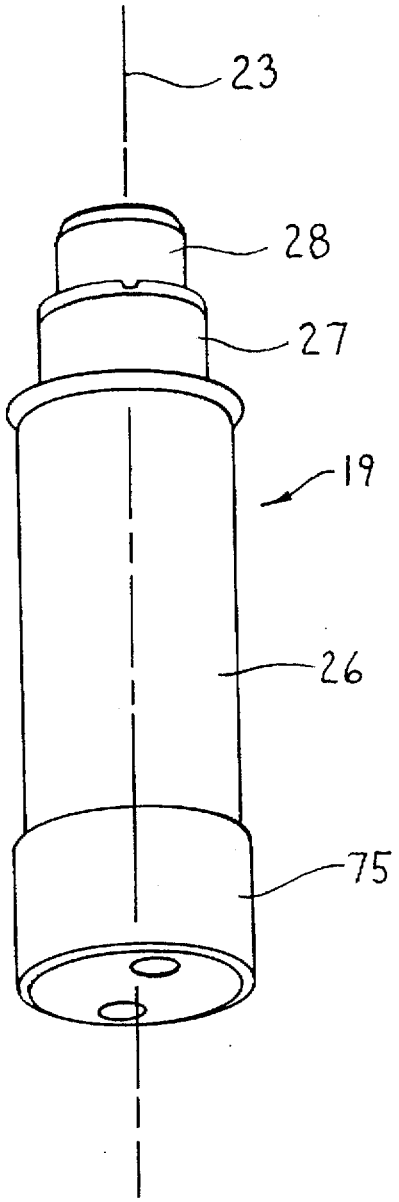
FIG. 2 is a perspective view of the improved height adjusting arrangement of this invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the mechanism and designated parts thereof. Said terminology will include the words specifically mentioned, derivatives thereof, and words of similar import.

DETAILED DESCRIPTION

Referring to the drawings and specifically FIG. 1, there is illustrated a chair 10 which includes a seat arrangement 11 supported on a base structure 12. The seat arrangement includes a back assembly 13 which is interconnected to and projects upwardly from the rear of the seat assembly 14. The seat and back assemblies are typically joined to a tilt control 16 which is disposed under the seat assembly so as to provide for desired movement of the seat and back, one common and exemplary control being what is conventionally known as a synchrotilt mechanism. The base structure 12 includes a conventional base defined by a plurality of outwardly projecting legs 17 which are traditionally provided with casters 18 adjacent the free ends thereof. The legs or base 17 are typically rigidly joined to the lower end of a height adjustable pedestal assembly 19, the latter at its upper end being coupled to the control 16. This overall arrangement of the chair 10, as briefly described above and as diagrammatically illustrated in FIG. 1, is conventional.

In the present invention, the height adjusting pedestal assembly 19, as illustrated, includes a first height adjusting mechanism 21 (FIG. 3) which defines a basic stroke over which the chair can be substantially continuously adjusted in height, and this first height adjusting mechanism 21 in turn is generally connected vertically in series with a second height adjusting mechanism 22 which effectively defines two height adjustment stages, namely upper and lower stages, as explained in detail hereinafter. These height adjusting mechanism 21 and 22 effectively cooperate about and define a central vertical axis 23, the latter being the central support and swivel axis for the seat arrangement 11.

Figure 3:
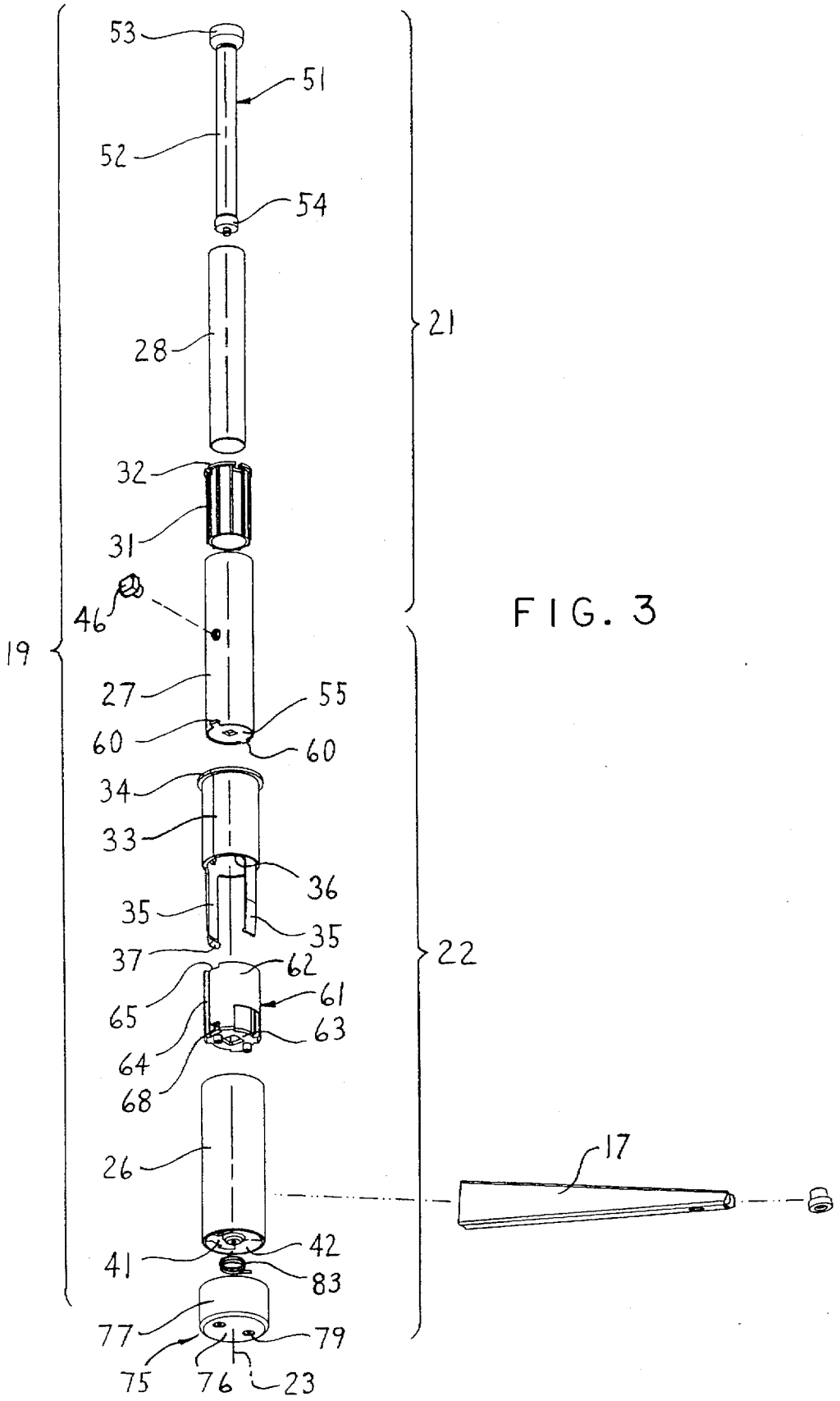
FIG. 3 is a vertically exploded view of the height adjusting arrangement.

As illustrated in FIG. 3, the height adjusting pedestal assembly 19 includes a lower or outer tube 26 which adjacent its lower end is fixedly secured to the outwardly projecting base legs 17. This lower tube 26 in turn is disposed in slidable and coaxial telescopic engagement with an intermediate tube 27, and the latter in turn is disposed in coaxial and slidable telescopic relation with an upper or inner tube 28. Each of these tubes 26–28 is a generally hollow but axially elongate cylinder.

The upper tube 28 is axially slidably supported within the intermediate tube 27 through a first cylindrical hubliner 31 interposed therebetween. This hubliner 31 is constructed generally as a cylindrical sleevelike bearing element which projects downwardly through a significant axial extent into the intermediate tube 27, with the upper end of the hubliner 31 having an outwardly projecting flange 32 which overlaps the upper end of the intermediate tube 27. Hubliner 27 is disposed in relative sliding and surrounding supportive engagement with the upper tube 28.

A second cylindrical hubliner 33 is stationarily mounted on and projects axially downwardly within the upper portion of the outer tube 26. This liner 33 is also constructed as a generally cylindrical sleevelike bearing and has a top outwardly projecting flange 34 which overlaps the upper end of the lower tube 26, whereby this hubliner provides for surrounding supportive but axial slidable engagement with the intermediate tube 27. This hubliner 33 is preferably constructed from two substantially half shells which resemble semi-cylindrical elements so as to facilitate manufacture and assembly.

The hubliner 33 projects only partway down from the upper end of the outer tube 26, such as about halfway, and has a pair of downward and axially projecting cantilevered resilient fingers 35 which project downwardly from the lower edge 36 of the liner. The fingers 35 are disposed on generally diametrically opposite sides of the hubliner. The fingers 35 at their lower ends terminate in radially inwardly projecting lock tabs 37 (FIG. 4), the latter having rounded camlike lower surfaces 38, and upper generally flat shoulders 39. The locking tabs 37 are positioned so that they radially deflect inwardly on opposite sides of a bottom plate 41 which is fixed to and extends transversely across the interior of the outer tube 26 adjacent the lower end thereof. The tabs 37 project under outer edges of the bottom plate 41 as shown in FIG. 4 so that the shoulders 39 abut the bottom surface of the bottom plate 41 to thus axially lock the hubliner 33 within the outer tube 26.

Figure 4:
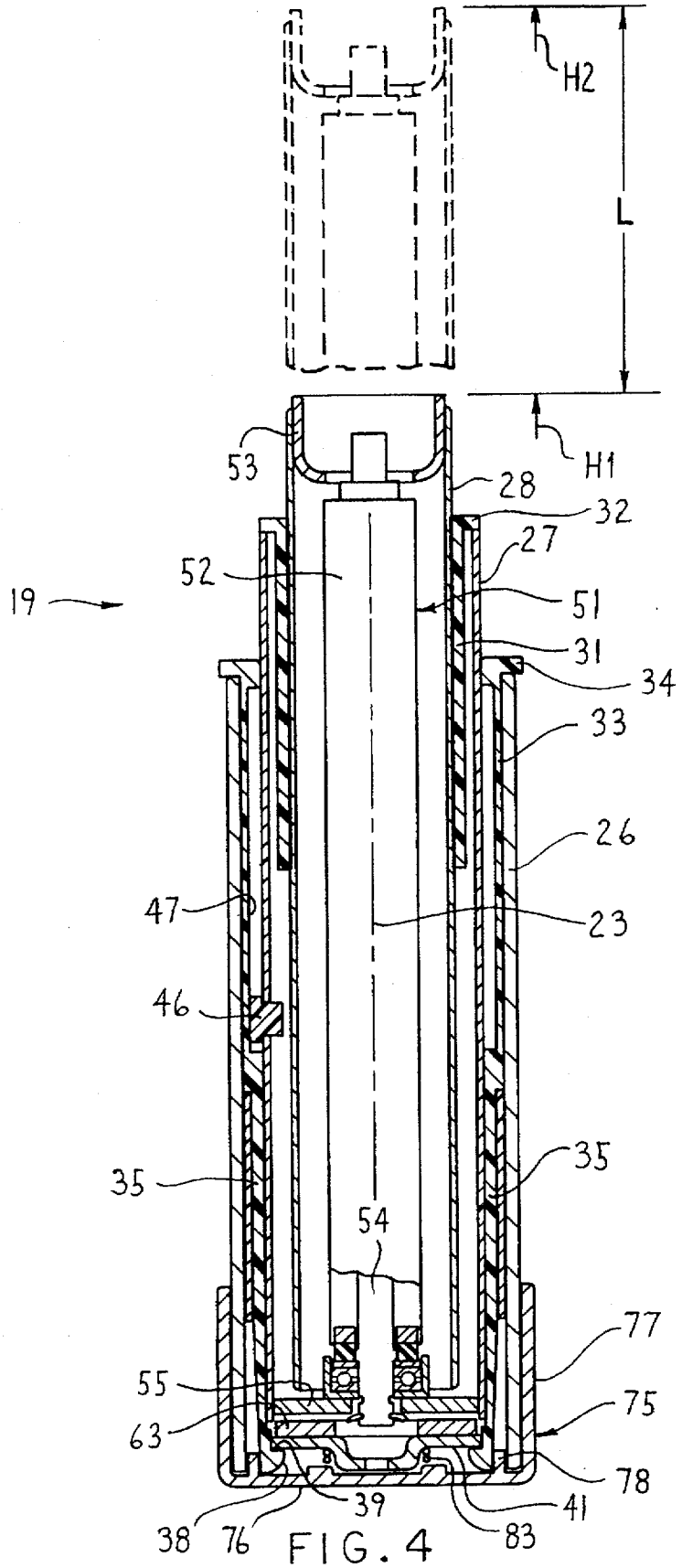
FIG. 4 is a central sectional elevational view of the height adjusting arrangement, with both first and second height-adjusting mechanisms being shown in their lowered positions, with dotted lines showing the upper fully extended position of the conventional first mechanism.

The bottom plate 41, in the illustrated embodiment, has a generally cruciform configuration when viewed in plan view, whereby this bottom plate 41 in cooperation with the surrounding outer tube 26 define openings 42 which project axially downwardly through the bottom plate, which openings 42 permit the free ends of the fingers 35 to project downwardly therethrough, with the lower camming surfaces 38 on the tabs causing the tabs 37 to initially deflect outwardly as they pass axially downwardly along the edge of the plate 41, with the tabs 37 then resiliently snapping back into engagement below the plate 41 substantially as illustrated by FIG. 4.

The intermediate tube 27 also has a shoe or key 46 mounted thereto, which key is secured adjacent the outer periphery of the tube 27 generally intermediate the ends thereof. The key 46 projects into an axially elongate key slot 47 formed in the inner wall of hubliner 33 to prevent rotation of the tube 27.

The first height adjusting mechanism 21 includes a generally conventional gas (i.e. pneumatic) cylinder or spring 51, the latter having a vertically elongate cylindrical housing 52 provided with a connector cup 53 at the upper end, the latter being fixedly secured to the upper end of the upper or inner tube 28, which tube 28 is disposed in surrounding relationship to the cylindrical housing 52. The gas spring 51 also has a vertically elongate piston rod 54 which is slidably supported on and projects axially downwardly from the cylinder housing 52. The piston rod 54 at its lower end is connected to an end plate 55 which extends transversely across and is fixedly secured to the lower end of the intermediate tube 27.

This connection involves a stop plate 56 which is fixed to the rod 54 and abuts a cushioning ring 57, the latter abutting a bearing 58 which rotatably connects between the rod and the end plate. A clip 59 connects to the lower free end of rod 54 to prevent separation thereof from the end plate.

The upper end of the gas spring 51 is interconnected to the chair control 16 in a conventional manner. This upper end of gas cylinder 51 is also provided with a valve actuator (not shown) projecting axially outwardly and disposed for activation by a conventional actuator (not shown) mechanism, such conventionally including a manually movable lever pivotally supported under the seat assembly and projecting sidewardly for engagement by the occupant. Such actuator for activating the gas cylinder is conventional, whereby further description thereof is believed unnecessary.

The end plate 55 fixed to the lower end of the intermediate tube 27 also defines thereon a pair of position control tabs 60 which project radially outwardly through slots provided on diametrically opposite sides of the tube 27. The tabs 60 projecting radially outwardly a significant distance beyond the radially outer surface of the tube 27 and terminate adjacent the inner peripheral wall of the outer tube 26. These control tabs 60 are part of the second height adjusting mechanism 22 which defines first and second (i.e., low and high) range shift positions with respect to the height adjusting stroke, as explained hereinafter.

Considering now the specifics of the second height adjusting mechanism 22, same includes a two-stage height adjusting member 61 which is positioned coaxially within the lower portion of the outer tube 26 generally below the hubliner 33. This adjusting member 61 is defined generally by an axially elongate sleeve 62 which projects coaxially of the axis 23 and has a transversely extending end wall 63 fixed thereto adjacent the lower end of the sleeve 62.

Figure 5:
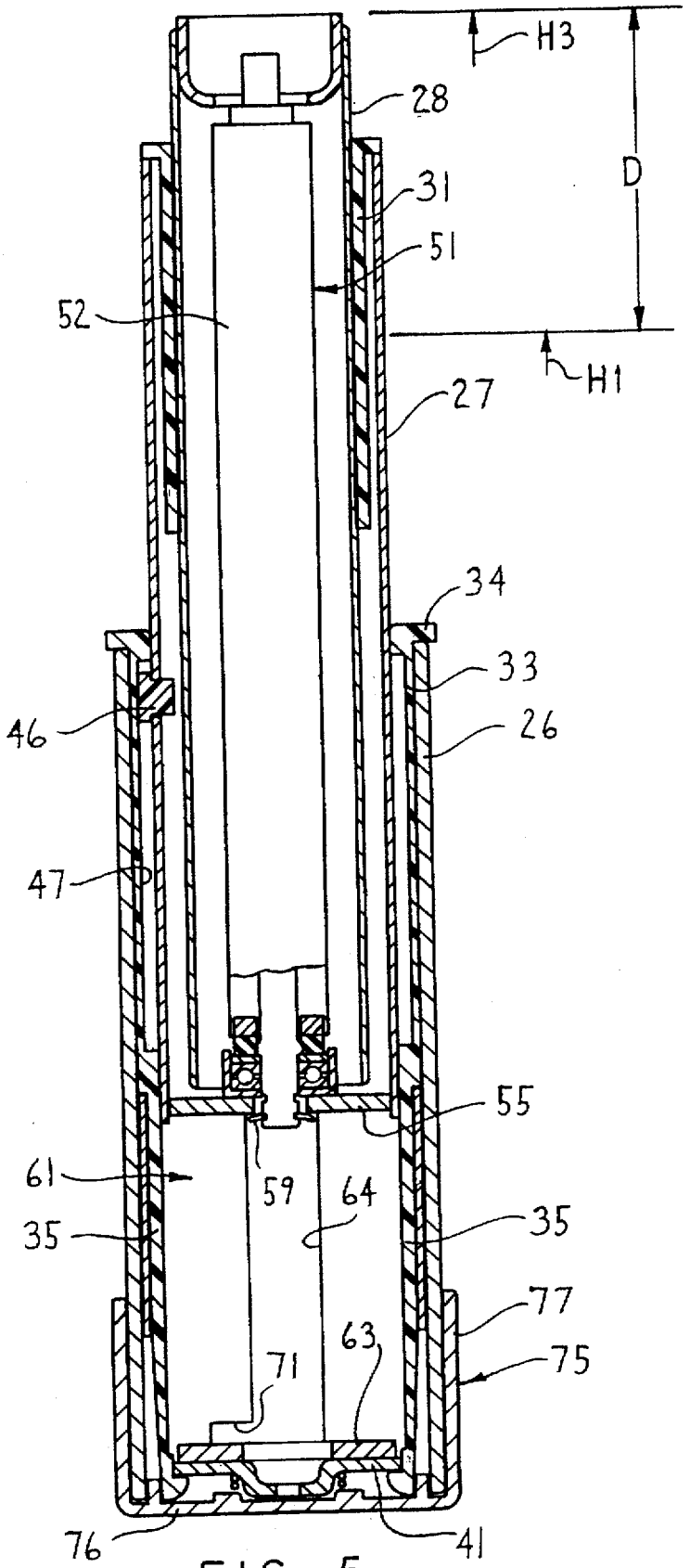
FIG. 5 is a central sectional view similar to FIG. 4 but showing the two-stage second height adjusting mechanism in its upper position, and the conventional first mechanism in its lowered or retracted position.
Figure 7:
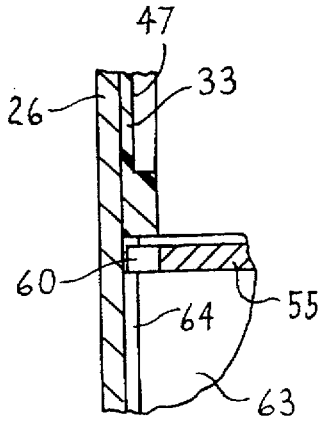
FIG. 7 is a fragmentary sectional view showing a portion of the mechanism similar to FIG. 6, but on a vertically rotated plane so as to illustrate the tab associated with the intermediate sleeve and its cooperation with the phase-shift sleeve.
Figure 6:
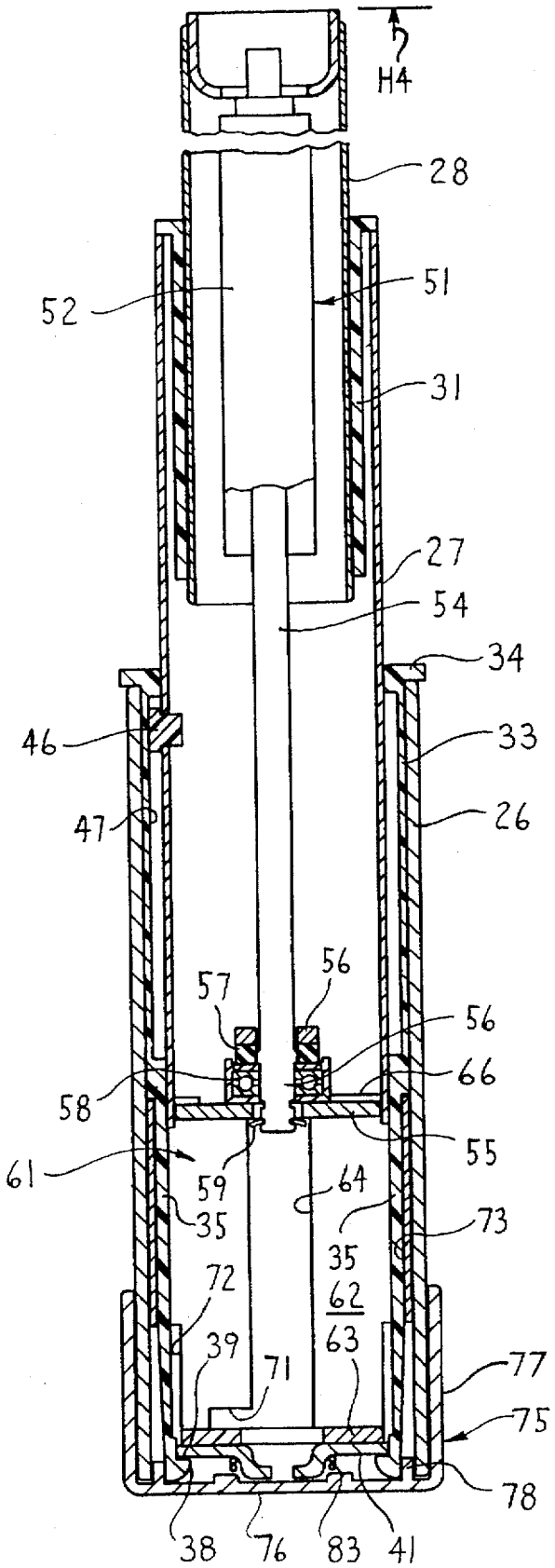
FIG. 6 is a view similar to FIG. 5 wherein the two-stage second mechanism in still in its upper position, and the first mechanism is also in its fully extended position.

As illustrated by FIGS. 4–6, the sleeve 62 is directly rotatably supported generally on the inner cylindrical wall of the outer tube 26 adjacent the lower end thereof, and the sleeve 62 includes two substantially diametrically opposite slots 64 formed therein and projecting axially throughout the length of the sleeve. Each slot 64 has a circumferential width which is only slightly greater than the circumferential width of the control tab 60, whereby the latter is adapted to project radially outwardly into the slot 64 so as to be vertically movable therealong between upper and lower positions.

Each axial slot 64 at its upper end communicates with a position-defining slot 65 which extends circumferentially in one direction so as to define an upwardly facing support shoulder 66, the latter shoulder 66 being spaced downwardly a small extent from the upper edge 67 of the sleeve and being joined thereto through an intermediate stop edge 68. This shoulder or surface 66 is sized so as to accommodate the control tab 60 thereon when the latter is in a raised position. A small upwardly projecting stop tab 69 is preferably provided between the surface 66 and the slot 64 to prevent the control tab 60 from inadvertently sliding sidewardly into the slot 64.

Each axial slot 64 at its lower end communicates with a further circumferentially-extending position-defining slot 71 which is disposed just upwardly from the end wall 63 and terminates in an edge 72. The lower slot 71 and the upper slot 65 both project circumferentially in the same direction away from the axial slot 64, and this lower slot 71 receives therein the control tab 60 when the latter is in a lowered position. The lower end of axial slot 64 is effectively closed off by the bottom plate 63.

Due to the generally diametrically opposed axial slots 64 and their cooperation with the upper and lower slots 65 and 71, respectively, the pair of control tabs 60 can be vertically displaced along the slots 64 and then rotatably displaced a small extent so as to seat either within the upper slots 65 or the lower slots 71, thereby respectively defining upper and lower base positions and hence defining the two stages for the height adjusting pedestal assembly.

Figure 9:
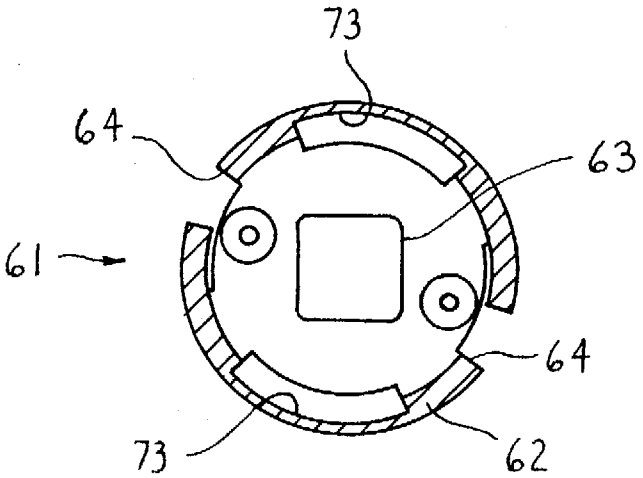
FIG. 9 is a sectional view taken generally along line 9—9 in FIG. 8.
Figure 8:
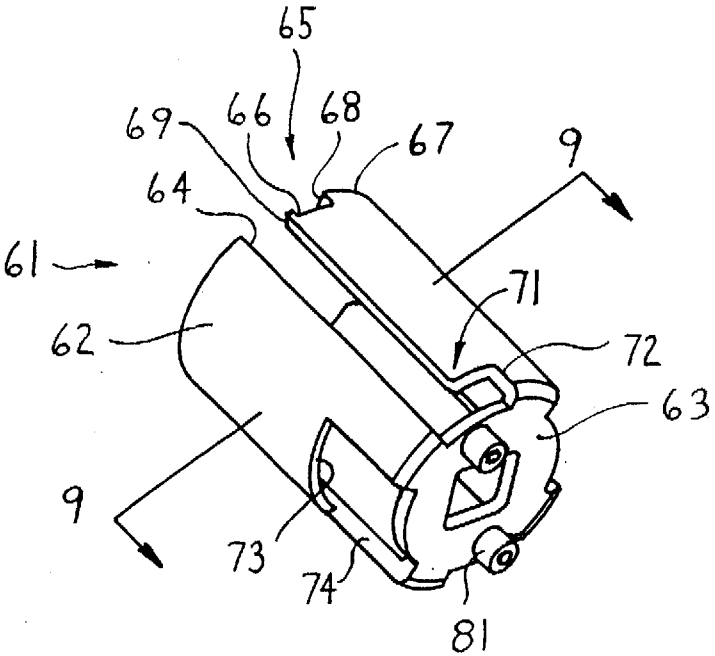
FIG. 8 is a perspective view of the phase-shift sleeve.
Figure 10:
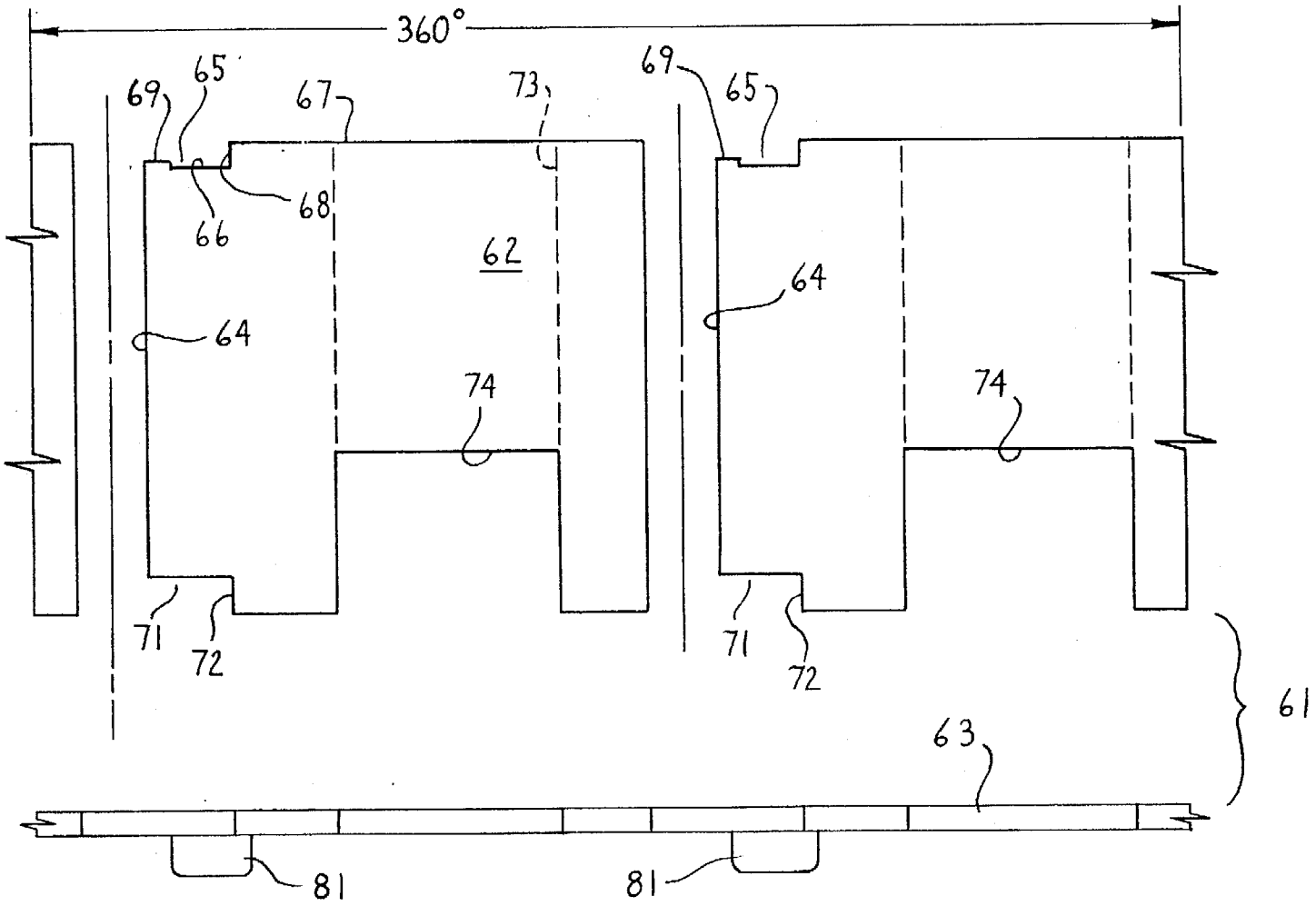
FIG. 10 illustrates the configuration of the phase-shift sleeve when drawn in a planar view.

The sleeve 62 of the adjusting member 61 has diametrically opposed shallow grooves 73 (FIG. 9) formed in the inner wall thereof, which grooves 73 are of substantial circumferential extent and also project axially along the length of the sleeve. These shallow grooves 73, which result in reduced thickness of the sleeve wall, accommodate therein the downwardly projecting fingers 35 associated with the hubliner 33. The wall of the sleeve 62, adjacent the lower end of each shallow groove 73, is provided with a generally rectangular cutout or opening 74 which projects downwardly through the lower end of the sleeve. This cutout 74 provides clearance for the lower end of the fingers 35 so that these fingers adjacent the lower free ends thereof can suitably resiliently deflect in a radial direction so as to permit proper assembly and disassembly of the overall pedestal assembly.

The adjusting member 61 is coupled to a control knob 75 so as to permit the member 61 to be selectively rotated at least a limited extent about the axis 23 to thereby move the control tabs 60 out of the slots 65 or 71 into a position for alignment with the axial slots 64 when adjustment between the upper and lower stages is desired. This control knob 75 in the illustrated embodiment is formed generally as a cup-shaped member having a generally flat end wall 76 which extends transversely between and is joined to an upwardly projecting cylindrical side wall 77, the latter being snugly but rotatably engaged with and around the lower portion of the outer tube 26. The control knob 75 is disposed generally below the base or legs 17. Control knob 75 has an inner annular guide flange 78 which projects upwardly from the end wall 76 in slightly inwardly but concentric relationship to the outer cylindrical wall 77. This inner annular guide flange 78 projects upwardly so as to be snugly interposed or sandwiched between the locking tabs 37 and the inner wall of the outer tube 26, as illustrated in FIGS. 4–6. A pair of fasteners such as screws 79 are mounted on and project upwardly from the end wall 76 and are engaged within threaded hubs 81 which are fixed to and project downwardly from the end wall 63 so as to fixedly and nonrotatably connect the control knob 75 to the adjusting member 61.

While the control knob 75 in the illustrated embodiment is formed generally as a cup-shaped member, it will be appreciated that numerous other configurations can be provided. For example, the control knob can be formed as a lever. Use of the cuplike knob, however, is preferred since such provides a symmetrical and nonprotruding appearance with respect to the base structure of the chair.

To normally maintain the control tabs 60 in either the upper or lower slots 65 and 71 depending upon which stage has been selected, there is provided a torsion spring 83 which is disposed axially between the bottom plate 41 and the hubs 81 of the adjustment sleeve 63. This torsion spring 83 has one end thereof slidably resting on the adjustment sleeve hubs 81 and the other end anchored to the bottom plate so as to rotatably bias the control knob 75 and stage adjustment member 61 into a position wherein the control tabs 60 always move into the respective slots 65 or 71 so as to abut against the steps or end edges thereof.

The operation of the height adjusting pedestal assembly 19 of this invention will now be described to ensure a complete understanding thereof.

Referring first to FIG. 4, there is illustrated the height adjusting pedestal 19 with both the first height adjusting mechanism 21 in its lowered or contracted position, and the stage adjusting mechanism 22 in its lower base position. In this latter position, the control tabs 60 project into the slots 71 defined at the lower end of the adjusting sleeve 61. In this position, activation of the pneumatic spring 51 in a conventional manner allows the gas spring to extend upwardly and thereby move the upper tube 28, upwardly so as to adjust the chair height, with the chair height being adjusted and stopped at any point along the maximum stroke of the cylinder 51. In FIG. 4, the maximum stroke of the cylinder 51 and the upper position of the chair, when the stage adjusting mechanism 22 is in its lower base position, is indicated by dotted lines. In the lower base position or lower stage illustrated by FIG. 4, the chair will thus move through a conventional stroke designated L in FIG. 4, this stroke L typically being about four and one-half inches. Further, the stroke extends from a lower height position H1 to an upper height position H2, with the lower height position H1 causing the height of the chair seat to be lower than the conventional minimum height of about 16 inches above the floor. For example, the height H1 of this invention will typically result in the chair seat being about 15 inches above the floor.

When it is desired to provide height adjustment at a higher elevation, then the adjusting mechanism 22 is activated and the seat assembly 11 is moved upwardly to a second base height as shown in FIG. 5 and as designated H3, which base height H3 is typically several inches, such as for example 2½ to 3 inches, above the lower base height H1. This adjustment into the upper base height position H3 is accomplished by manually gripping and rotating the control knob 75 and hence the control sleeve 63 against the urging of the spring 83 to withdraw the control tabs 60 from the lower slots 68 and thus align the tabs 60 with the lower ends of the axial slots 64. The seat arrangement 11 is then manually displaced relative to the base 17 so as to cause the control tabs 60 to slide along the slots 64 until reaching the upper ends thereof, at which time the spring 83 rotatably urges the control sleeve 63 and knob 75 back to its original position so that the control tabs 60 enter the upper slots 65 and seat against the shoulders 66 and 67. The control tabs 60 are thus secured within the upper slots and bear against the shoulders 66 to cause the intermediate tube 27 to be axially fixed relative to the lower tube 26 but in an extended position as illustrated by FIG. 5. The stops 69 prevent the tabs 60 from reentering the slots 64. In this position of FIG. 5, namely with the gas spring 51 contracted, the chair is thus at the lowermost height position designated H3. The chair can then be extended upwardly through the normal stroke L by activation of the gas spring 51 so that the chair will move to an upper height position designated H4. In this upper stage, the chair still has the same height adjusting stroke L as defined by the gas spring 51, but this stroke L has now been shifted upwardly so as to be defined upwardly from the base height H3, in contrast to the lower stage where the stroke L is measured upwardly from the base height H1 as illustrated by FIG. 4.

With the arrangement of this invention, the two-stage height adjusting mechanism 22 preferably provides a vertical displacement distance D (FIG. 5) between the two base heights, namely the heights H1 and H3, which distance D is preferably at least about 50% of the maximum stroke length L defined by the height adjusting gas spring 51. This thus results in the overall maximum chair height adjustment range being extended in that it now extends from a lowermost height corresponding to position H1 to an uppermost height corresponding to position H4, but at any time the height is only adjustable through the conventional stroke L, either in the lower stage between the height positions H1 and H2, or in the upper stage between the height positions H3 and H4. Because of the geometric relationship between the height adjustment D between the first and second base stages as defined by the mechanism 22 relative to the stroke height L defined by the adjusting mechanism 21, the upper height position H2 when in the lower stage position is significantly above the lower stage height position H3, and there is thus defined a significant overlapping height differential between the height positions H2 and H3 which exists at all times, irrespective of whether the chair is in the upper or lower height stage.

While the height adjusting pedestal in the illustrated embodiment relies on manual displacement of the base structure relative to the seat arrangement to permit adjustment between the upper and lower height adjusting stages designated by positions H1 and H3, it will be appreciated that such could be assisted by a spring if desired. For example, a spring such as a coil spring could be integrated into the pedestal and disposed to provide an upward force to assist in effecting upward displacement of the seat when being raised from the lower base position to the upper base position, with lowering being controlled manually in opposition to the urging of the spring.

In the illustrated embodiment, however, the adjustment of mechanism 22 preferably is accomplished by first tipping the chair 90° so that its side is supported on the floor. This thus allows convenient access to the knob 75. One hand then grips and holds the seat arrangement 11. The other hand grips and rotates the knob 75, and then pushes or pulls on the knob to adjust the mechanism into the respective upper or lower stage position. Knob 75 is released, and spring 83 causes the control tabs 60 to enter the slots 65 or 71. The chair is then tipped back into its upright position.

While the pedestal assembly 19 has been illustrated and described with the mechanisms 21 and 22 positioned respectively at the upper and lower ends thereof, and such is believed preferable, nevertheless it will be recognized that the axial positional relationship of mechanisms 21 and 22 can be reversed and still provide the same two-stage vertical shifting of the height adjusting stroke as experienced by the seat of the chair.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a chair having a base adapted for support on a floor, a seat-back arrangement for accommodating an occupant, and an upright height adjustable pedestal assembly connected vertically between said base and said seat-back arrangement for supporting the latter and permitting the height thereof to be vertically adjusted, the improvement wherein said height adjustable pedestal assembly comprises:

a first height adjusting mechanism having a predetermined vertical stroke defined between upper and lower stroke limiting positions for permitting the height of the seat-back arrangement to be adjusted to any position along said stroke;

a second height adjusting mechanism defining at least upper and lower vertically-displaced and predefined range positions for said stroke for permitting the vertical length of the pedestal assembly to be respectively increased and decreased, whereby said seat-back arrangement is movable along said stroke of said first height adjustment mechanism when said stroke is disposed in said upper range position and when said stroke is disposed in said lower range position; and said first and second height adjusting mechanisms being connected vertically in series, and each being independently operable.

2. A chair according to claim 1, wherein said second height adjusting mechanism includes first and second vertically elongate members which are relatively vertically movable between vertically extended and contracted positions which correspond to said upper and lower range positions respectively, and adjusting means cooperating between said first and second elongate members for permitting relative vertical movement of said stroke between said upper and lower range positions by said vertical movement of said first and second elongate members and for effecting vertical securement of the first and second elongate members together in a selected one of said upper and lower range positions to prevent relative vertical movement therebetween.

3. A chair according to claim 1, wherein said upper and lower stroke limiting positions of said stroke when in said lower range position are vertically-displaced relative to said upper and lower stroke limiting positions when in said upper range position.

4. A chair according to claim 1, wherein said first height adjusting-mechanism is moved vertically by said second height adjusting mechanism to position said stroke in one of said upper and lower range positions.

5. A chair according to claim 4, wherein said first height adjusting mechanism includes a first member supported on said base by said second height adjusting mechanism, a second member which supports said seat-back arrangement, and height-adjustment means connected between said first and second members for moving said second member vertically relative to said first member between said upper and lower stroke limiting positions, said first member being connected to said second height adjusting mechanism so that said first member is vertically movable between upper and lower positions which respectively define said upper and lower range positions of said stroke wherein said first member is positioned in either one of said upper and lower positions to position said stroke in one of said upper and lower range positions.

6. A chair according to claim 1, wherein said second height adjusting mechanism comprises first and second cooperating members which are relatively vertically movable between said upper and lower range positions, said first member being connected to one of said base and said seat-back arrangement, said first height adjusting mechanism comprising a fluid pressure cylinder connected to said second member and the other of said base and said seat-back arrangement to permit continuous adjustment of said seat-back arrangement throughout said stroke.

7. A chair according to claim 6, wherein said second member is positionable solely in either one of said upper and lower range positions.

8. A chair according to claim 6, wherein one of said first and second members includes vertically spaced apart first and second stop parts corresponding to said upper and lower range positions and the other of said first and second members includes a cooperating third stop part which is engagable with either of said first and second stop parts to stationarily secure said first and second members together.

9. In a chair having a base adapted for support on a floor, a seat-back arrangement for accommodating an occupant, and an upright telescopic height adjustable pedestal assembly connected vertically between said base and said seat-back arrangement for supporting the latter and permitting the height thereof to be vertically adjusted, the improvement wherein said height adjustable pedestal assembly comprises:

a first height adjusting mechanism having a predetermined vertical stroke defined between upper and lower stroke limiting positions for permitting the height of the seat-back arrangement to be adjusted to any position along said stroke;

a second height adjusting mechanism defining at least upper and lower vertically-spaced and predefined range positions for permitting the vertical length of the pedestal assembly to be respectively increased and decreased, whereby said seat-back arrangement can be subjected to said stroke of said first height adjustment mechanism when in either of said upper and lower range positions, said second height adjusting mechanism including first and second vertically elongate members which are relatively vertically movable between vertically extended and contracted positions which correspond to said upper and lower range positions respectively and adjusting means cooperating between said first and second elongate members for permitting relative vertical movement of said stroke between said upper and lower range positions by said vertical movement of said first and second elongate members and for effecting vertical securement of the first and second elongate members together in a selected one of said upper and lower range positions to prevent relative vertical movement therebetween;

said first and second height adjusting mechanisms being connected vertically in series, and each being independently operable, said first height adjusting mechanism further comprising a vertically elongate telescopically extendible and contractible gas cylinder unit having one end thereof connected to said second vertically elongate member, and the other end of said gas cylinder unit being connected to one of said base and said seat-back arrangement; and said first vertically elongate member being connected to the other of said base and said seat-back arrangement.

10. In a chair having a base adapted for support on a floor, a seat-back arrangement for accommodating an occupant, and an upright telescopic height adjustable pedestal assembly connected vertically between said base and said seat-back arrangement for supporting the latter and permitting the height thereof to be vertically adjusted, the improvement wherein said height adjustable pedestal assembly comprises:

a first height adjusting mechanism having a predetermined vertical stroke defined between upper and lower stroke limiting positions for permitting the height of the seat-back arrangement to be adjusted to any position along said stroke;

a second height adjusting mechanism defining at least upper and lower vertically-displaced and predefined range positions for said stroke for permitting the vertical length of the pedestal assembly to be respectively increased and decreased, whereby said seat-back arrangement can be moved along said stroke of said first height adjustment mechanism when in either of said upper and lower range positions, said first and second height adjusting mechanisms being connected vertically in series, and each being independently operable;

said pedestal assembly including first, second and third hollow tubes which are vertically coaxially aligned and relatively telescopically slidable relative to one another, one of said first and third tubes being fixedly connected to said seat-back arrangement, and the other of said first and third tubes being fixedly connected to said base;

said first height adjusting mechanism being disposed generally within and operatively connected between said first and second tubes for controlling relative vertical extension and contraction between said first and second tubes; and said second height adjusting mechanism being positioned generally internally of said pedestal and operatively cooperating between said second and third tubes to permit said second tube to be selectively stationarily secured relative to said third tube in either of said upper and lower range positions wherein said second tube is respectively extended and contracted relative to said third tube.

11. A chair according to claim 10, wherein said second adjusting mechanism includes a vertically elongate slot which is vertically fixedly associated with respect to one of said second and third tubes and which slidably accommodates therein a projecting part which is fixedly associated with the other of said second and third tubes, said slot projecting vertically through a distance which corresponds generally to the spacing between said upper and lower range positions, said slot at its upper end communicating with a circumferentially projecting support ledge which defines said upper range position, said projecting part being vertically supportedly engaged with said support ledge when said projecting part is in said upper range position.

12. A chair according to claim 11, wherein said second height adjusting mechanism includes a range adjustment sleeve which is axially secured relative to said third tube but is concentrically rotatably positioned relative to said third tube, said adjustment sleeve having said slot extending vertically thereof and terminating at said support ledge adjacent an upper end thereof, and a manually-accessible control element connected to said adjustment sleeve for permitting rotational displacement thereof.

13. A chair according to claim 10, wherein said first tube is an upper tube fixedly connected to said seat-back arrangement, said third tube is a lower tube fixedly connected to said base, and said second tube is an intermediate tube.

14. A chair according to claim 13, wherein said second adjusting mechanism includes a vertically elongate slot which is vertically fixedly associated with respect to one of said lower and intermediate tubes and which slidably accommodates therein a projecting part which is fixedly associated with the other of said lower and intermediate tubes, said slot projecting vertically through a distance which corresponds generally to the spacing between said upper and lower range positions, said slot at its upper end communicating with a circumferentially projecting support ledge which defines said upper range position, said projecting part being vertically supportedly engaged with said support ledge when said projecting part is in said upper range position.

15. A chair according to claim 14, wherein said second height adjusting mechanism includes a range adjustment sleeve which is axially secured relative to said outer tube but is concentrically rotatably positioned interiorly of said outer tube adjacent a lower axial end thereof, said adjustment sleeve having said slot extending vertically thereof and terminating at said support ledge adjacent an upper end thereof, and a manually-accessible control knob positioned under said base adjacent the lower end of said outer tube, said control knob being fixedly connected to said adjustment sleeve for permitting rotational displacement thereof by gripping and rotating said control knob.

16. A chair according to claim 13, wherein one of said first and second height adjusting mechanisms is supported on said base and the other of said first and second height adjusting mechanisms is supported on said second height adjusting mechanism, said seat-back arrangement being supported on said other of said first and second height adjusting mechanisms.

17. In a chair having a base adapted for support on a floor, a seat-back arrangement for accommodating an occupant, and an upright telescopic height adjustable pedestal assembly connected vertically between said base and said seat-back arrangement for supporting the latter and permitting the height thereof to be vertically adjusted, the improvement wherein said height adjustable pedestal assembly comprises:

a first height adjusting mechanism having a predetermined vertical stroke defined between upper and lower stroke limiting positions for permitting the height of the seat-back arrangement to be adjusted to any position along said stroke;

a second height adjusting mechanism defining at least upper and lower vertically-spaced and predefined range positions for permitting the vertical length of the pedestal assembly to be respectively increased and decreased, whereby said seat-back arrangement can be subjected to said stroke of said first height adjustment mechanism when in either of said upper and lower range positions, said second height adjusting mechanism including first and second vertically elongate members which are relatively vertically movable between vertically extended and contracted positions which correspond to said upper and lower range positions respectively; and said first and second height adjusting mechanisms being connected vertically in series, and each being independently operable, said second height adjusting mechanism including a vertically elongate slot vertically fixedly associated with said first elongate member and extending vertically between said upper and lower range positions, upper and lower transversely extending support ledges defined adjacent opposite vertical ends of said slot and respectively defining said upper and lower range positions, and a projecting part vertically fixedly associated with said second elongate member and being supportable on a selected one of said ledges and slidable vertically along said slot.

18. A chair according to claim 17, wherein said first height adjusting mechanism comprises a vertically elongate telescopically extendible and contractible gas cylinder unit having one end thereof connected to said second vertically elongate member and the other end thereof connected to said seat-back arrangement, and said first vertically elongate member being connected to said base.

19. A chair according to claim 17, wherein said adjusting means includes an adjustment sleeve which is horizontally rotatably but vertically fixed relative to said first elongate member, said adjustment sleeve being vertically elongate and defining said slot and said ledges thereon.

20. In a chair having a base, a seat assembly for accommodating an occupant, and an upright height adjustable pedestal assembly connected vertically between said base and said seat assembly for supporting the seat assembly and permitting the height thereof to be vertically adjusted, comprising the improvement wherein said height adjustable pedestal assembly comprises:

a first height adjusting mechanism which defines a vertical stroke extending between upper and lower limiting positions for permitting the height of the seat assembly to be adjusted to any position along said stroke; and a second height adjusting mechanism connected to said first height adjusting mechanism which positions said upper and lower limiting positions either at first and second heights respectively to define a lower range position for said stroke or at third and fourth heights respectively which are respectively vertically-displaced relative to said first and second heights to define an upper range position for said stroke, said seat assembly being movable along said stroke when said stroke is disposed either in said upper range position or said lower range position.

21. A chair according to claim 20, wherein said first height adjusting mechanism includes a first member connected to said second height adjusting mechanism and a second member connected to said seat assembly, said second member being vertically movable relative to said first member to define said upper and lower limiting positions of said stroke, said first member being supported by said second height adjusting mechanism either in raised or lowered positions, said upper and lower limiting positions being disposed in said first and second heights when said second member is in said lowered position and said third and fourth heights when said second member is in said raised position.

22. A chair according to claim 20, wherein said height adjustable pedestal assembly has a first vertical length when said lower limiting position is disposed at said second height and a second length when said lower limiting position is disposed at said fourth height, said first length being greater than said second length.

* * * * *